United States Patent [19]

Kubert

[11] 4,365,552

[45] Dec. 28, 1982

[54] AUTOMATIC CYLINDER SKEWING APPARATUS

[75] Inventor: Vincent T. Kubert, Arlington, Tex.

[73] Assignee: Harris Corporation, Melbourne, Fla.

[21] Appl. No.: 151,739

[22] Filed: May 20, 1980

[51] Int. Cl.[3] ..... B41F 7/04; B41F 7/26

[52] U.S. Cl. ..... 101/218; 101/144; 101/147; 101/352

[58] Field of Search ..... 101/148, 351, 352, 247, 101/218, 349, 350, 137, 139, 140, 143, 144, 145, 209, 147

[56] References Cited

U.S. PATENT DOCUMENTS

| | | | |
|---|---|---|---|
| 1,840,009 | 1/1932 | Ball et al. | 101/350 |
| 3,065,690 | 11/1962 | Heller et al. | 101/247 X |
| 3,167,025 | 1/1965 | Nothmann | 101/352 X |
| 3,208,377 | 9/1965 | Hantscho | 101/352 X |
| 3,603,254 | 9/1971 | Siebke | 101/148 |
| 3,691,956 | 9/1972 | James et al. | 101/247 |
| 3,817,173 | 6/1974 | Merbold et al. | 101/352 X |
| 4,214,527 | 7/1980 | Kamota | 101/247 |

FOREIGN PATENT DOCUMENTS

| | | | |
|---|---|---|---|
| 604565 | 4/1948 | United Kingdom | 101/247 |

*Primary Examiner*—Edgar S. Burr
*Assistant Examiner*—Charles Pearson
*Attorney, Agent, or Firm*—Yount & Tarolli

[57] ABSTRACT

A cam mechanism is described for automatically skewing a second cylinder in a printing press, such a form roller (24), in response to skewing of a first cylinder thereof, such as a plate cylinder (12), and for throw-on/throw-off of the second cylinder. The mounting (80, 82) for each end of the second cylinder is biased against a corresponding cam (74, 76), both cams being carried on a common cam shaft (78). A linkage (90) couples the cam shaft (78) to an eccentric (52) used for skewing the first cylinder (12). Upon skewing of the first cylinder (12), the linkage (90) rotates the cam shaft (78). The profiles of the cams (74, 76) are selected to be different so that this rotation of the cam shaft (78) causes one end of the second cylinder (24) to move to a greater extent than the other end, thereby skewing it by an amount matching the skewing of the first cylinder. An actuator (108) is provided for rotating the cam shaft (78) beyond the range of positions produced by the linkage (90) for throw-off of the second cylinder. The profiles of the cams (74, 76) are selected so that such rotation causes both ends of the second cylinder (24) to move out of contact with the first cylinder (12).

5 Claims, 6 Drawing Figures

AUTOMATIC CYLINDER SKEWING APPARATUS

BACKGROUND AND FIELD OF THE INVENTION

The present invention relates to rotary printing presses, and more particularly to apparatus for automatically skewing one cylinder of the rotary printing press, such as a form roller, in response to skewing of another cylinder thereof, such as a plate cylinder.

In rotary printing presses, particularly mutlicolor web printing presses, it is desirable to provide an adjustment for skewing or cocking of the plate cylinder axis relative to the axis of its coacting blanket cylinder. This is because of possible skew in the mounting of the printing plate on the plate cylinder, or skew of the image on the printing plate. Either of these types of skew can produce misalignment of the printed image produced on the web by one printing couple with printed images printed by other printing couples. By skewing the axis of the plate cylinder this misalignment can be eliminated. When the axis of the plate cylinder of a rotary printing press is skewed relative to the axis of its cooperating blanket cylinder, it is known to also skew a form roller which cooperates with the plate cylinder to maintain the axes thereof in substantial parallelism. Also, the form roller in a printing press, as is well known, may be moved between a thrown-off position and a thrown-on position. In the thrown-on position the form roller is in a liquid transfer relationship with a plate on the plate cylinder. In the thrown-off position the form roller is spaced from the plate cylinder and in a non-liquid transfer relationship with a plate on the plate cylinder.

The patent to James, U.S. Pat. No. 3,691,956, illustrates a typical mechanism for moving the ink form rollers between thrown-on and thrown-off positions. Specifically, the patent illustrates the biasing of form roller mountings against rockable cam rings. The cam rings are rotated in order to affect throw-on and throw-off of the form roll.

There are known mechanisms which provide for movement of a form roll between thrown-on and thrown-off positions and also provide for skewing the axis of the ink form roll relative to the axis of the blanket cylinder in response to skew of the plate cylinder axis relative to the blanket cylinder axis. Typical of these patents are U.S. Pat. Nos. 3,065,690; 3,167,025; 3,208,377 and 3,817,173.

SUMMARY OF THE INVENTION

The present invention provides a unique adjustment mechanism which maintains the axis of one press cylinder, such as the ink form roller, in a predetermined relationship with the axis of another press cylinder, such as the plate cylinder, upon skewing the axis of the other press cylinder relative to such other press structure as the axis of a coacting blanket cylinder. The invention provides a cam mechanism to effect both skewing of the form roll in response to skewing of the plate cylinder and also throw-on/throw-off movement of the form roller.

In accordance with the present invention, a rotary press is provided which includes first and second cylinders which may, for example, be the plate cylinder and form roller, respectively. Means are provided for skewing the axis of the plate cylinder relative to the axis of its associated blanket cylinder. Also, means are provided to simultaneously skewing the axis of a form roll relative to the axis of the blanket cylinder so that the axis of the form roll and the axis of the plate cylinder remain in substantial parallelism. Also, means are provided to move the form roll between thrown-on and thrown-off positions. In accordance with the present invention, these functions are achieved by a simple mechanism which involves a pair of cams and cam followers. The cam followers are attached to the supports for respective opposite ends of the form rollers. The cams are both moved to effect movement of the form roll between its thrown-on and thrown-off positions. At least one cam is moved to cause the form roll to skew with the plate cylinder and thus maintain their axes in parallelism. In the preferred embodiment the amount of movement of the at least one cam to effect the skewing with the plate cylinder is less than the amount the one cam is moved to throw on or throw off the form roll.

In the specific embodiment which will hereinafter be described, a rotary printing press includes a pair of spaced side frames, a plate cylinder, and a blanket cylinder journaled for rotation in the side frames. The plate cylinder is carried at one end thereof on an eccentric which is rotationally mounted to the adjacent side frame on an axis which is offset with respect to the axis of the cylinder whereby rotation of the eccentric will shift the adjacent end of the plate cylinder relative to its coacting blanket cylinder, thereby skewing the plate cylinder axis relative to the axis of the blanket cylinder. A form roller is located adjacent the plate cylinder and is supported by means of hanger sockets attached to the ends of the form roller, which hanger sockets are pivotally mounted for swinging movement so that the roller may be swung towards and away from the plate cylinder. A cam shaft is mounted generally parallel to the axis of the form roller and carries two cams. A cam follower is associated with each of the cams and operatively connected to a corresponding pivoting hanger socket. Rotation of the cams causes pivoting movement of the hanger sockets and thus the form roll to an extent which is dependent upon the cam profile.

The profiles for the two cams are selected to be different from one another such that rotation of the cam shaft affects different movements at the two ends of the form roller, thereby causing skewing of the form roller. A linkage is connected between the eccentric associated with the plate cylinder and the cam shaft for rotating the cam shaft, and thereby the first and second cams, by an amount dependent upon the amount of rotation of the eccentric. Thus, upon rotation of the eccentric the linkage rotates the cam shaft so as to skew the form roller and thereby maintain the axis of the plate cylinder and the axis of the form roll in parallelism. Thus, the axis of the form roller is automatically skewed relative to the axis of the blanket cylinder in response to skewing the axis of the plate cylinder relative to the axis of the blanket cylinder.

Also the same two cams are used to throw off the form roller. A linear actuator is disposed connected between the frame member and the cam shaft so that, upon actuation of the actuator, the cam shaft is rotated beyond the range of movement which produces skewing of the form roller. The cam surfaces are such that the form roller is moved out of fluid transferring relationship with the plate cylinder when the cams are rotated by the actuator.

BRIEF DESCRIPTION OF THE DRAWINGS

The foregoing and further features of the present invention will become apparent from the following detailed description thereof made with reference to the accompanying drawings, wherein.

Figure 3:
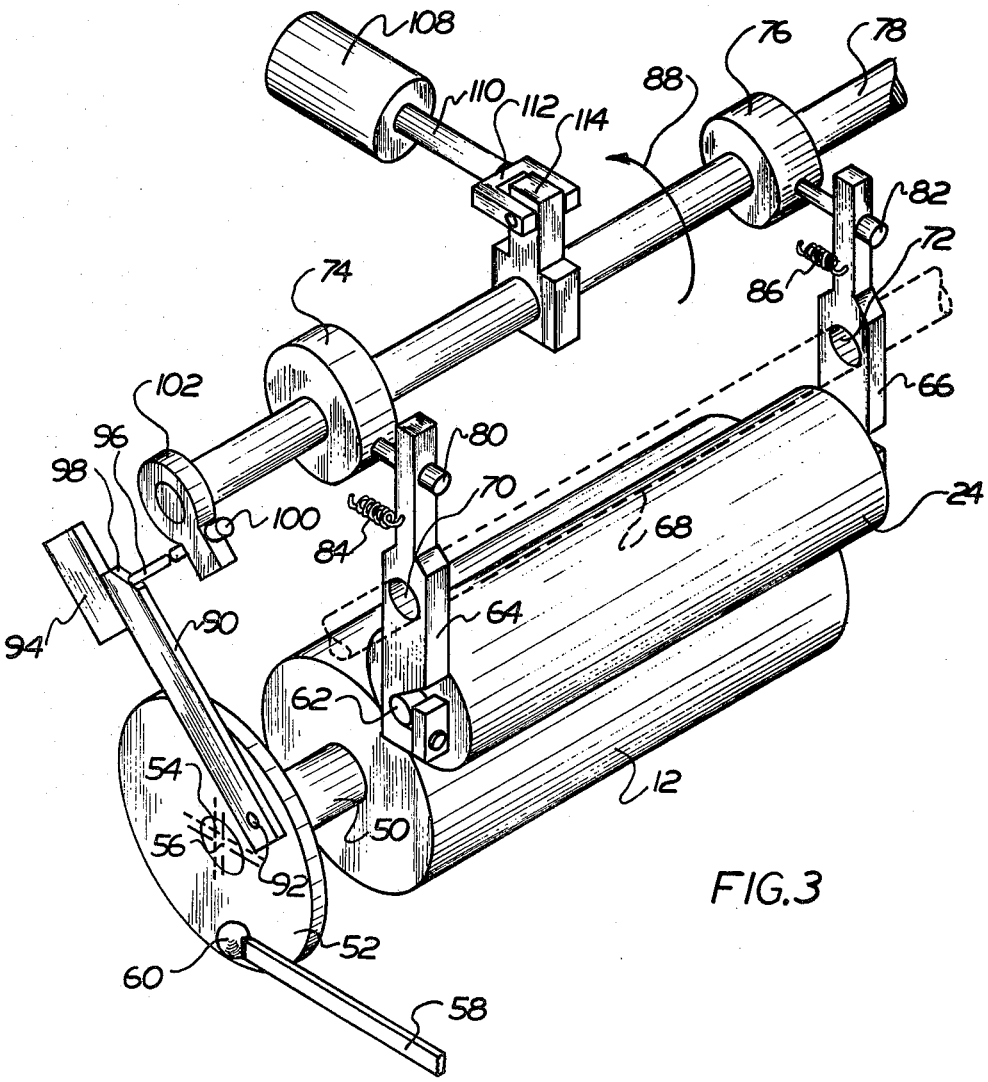
FIG. 3 is a simplified perspective illustration of a form roller throw-on/throw-off and skewing mechanism in accordance with the teachings of the present invention.
Figure 4:
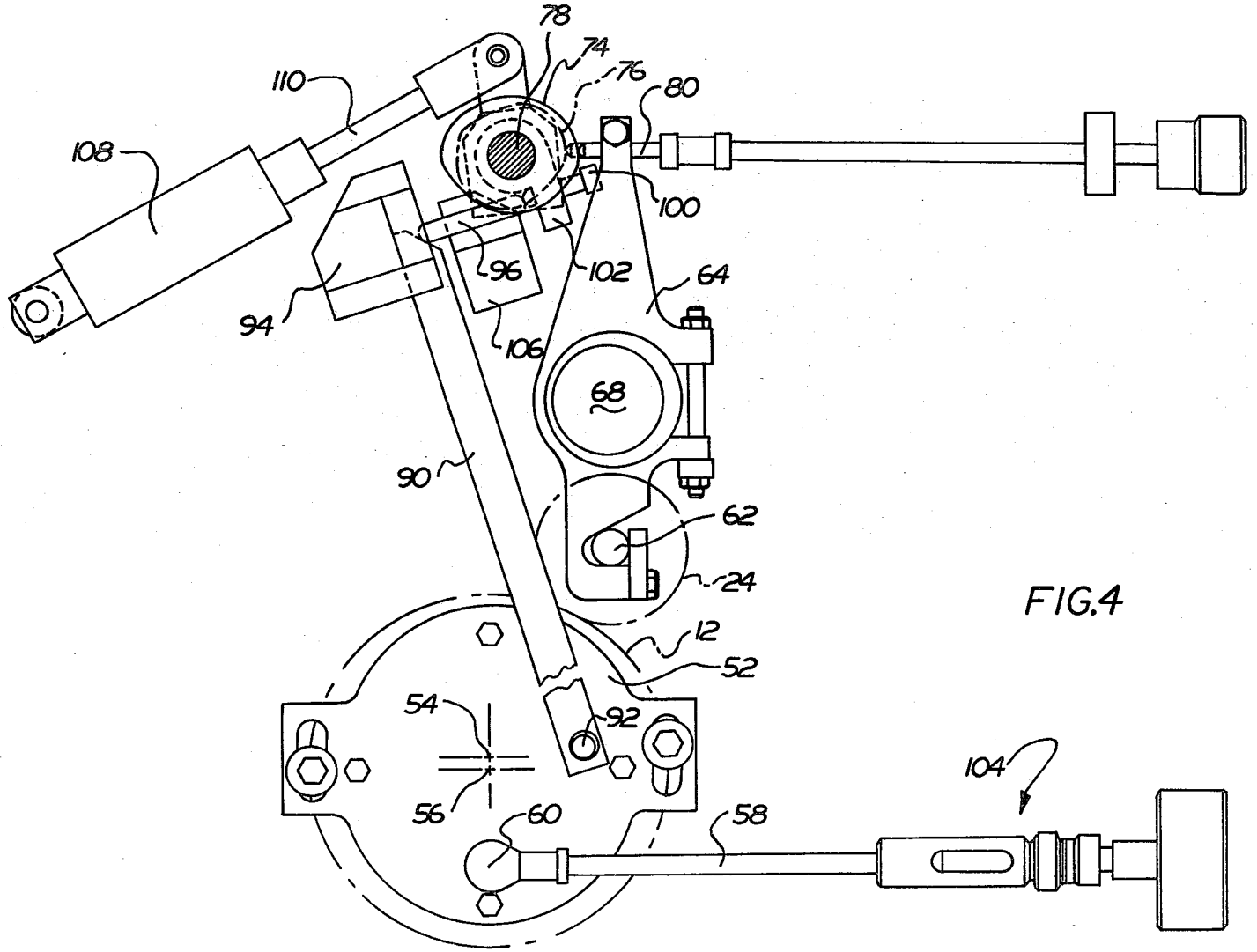
Figure 5:
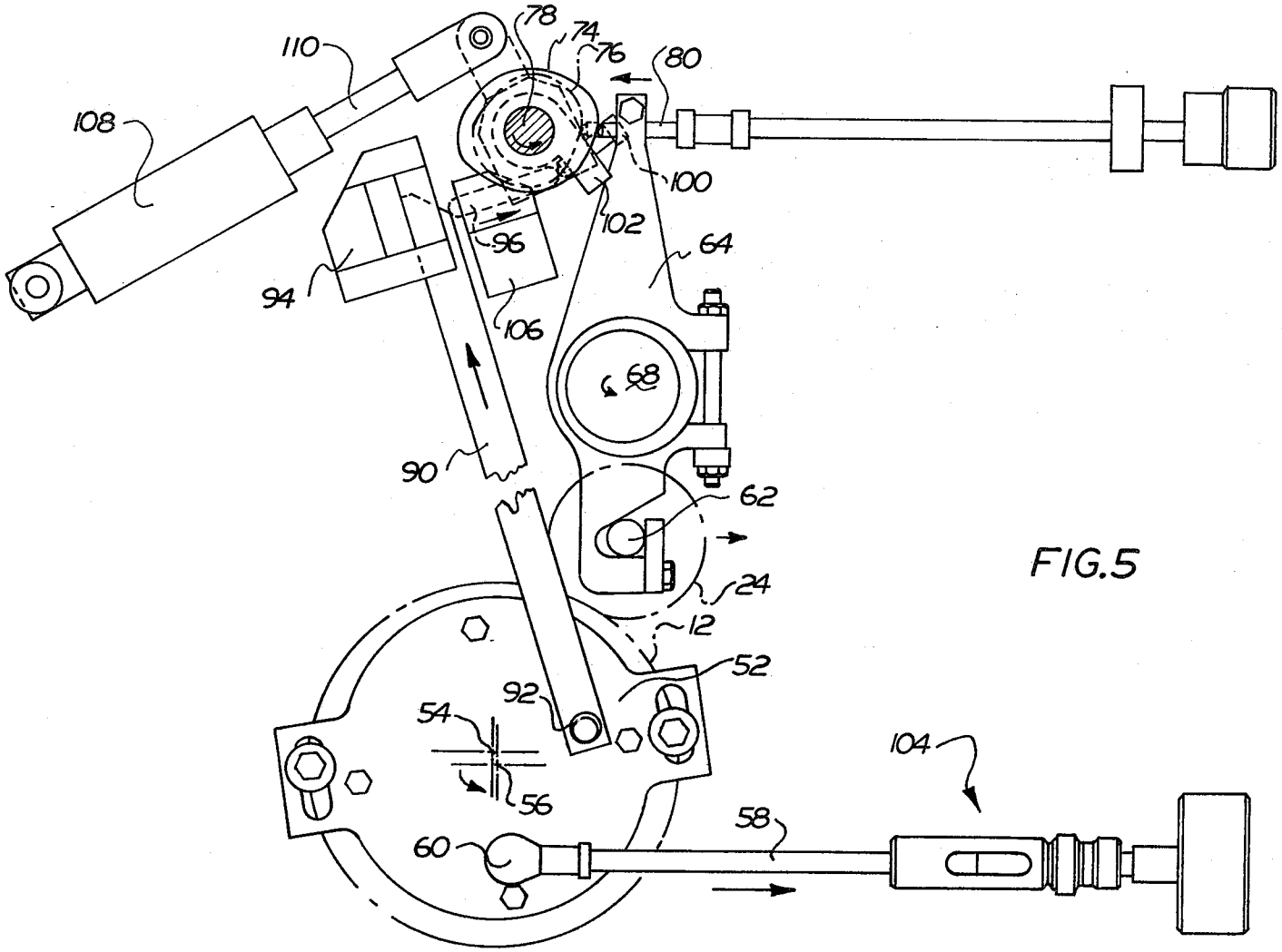
Figure 6:
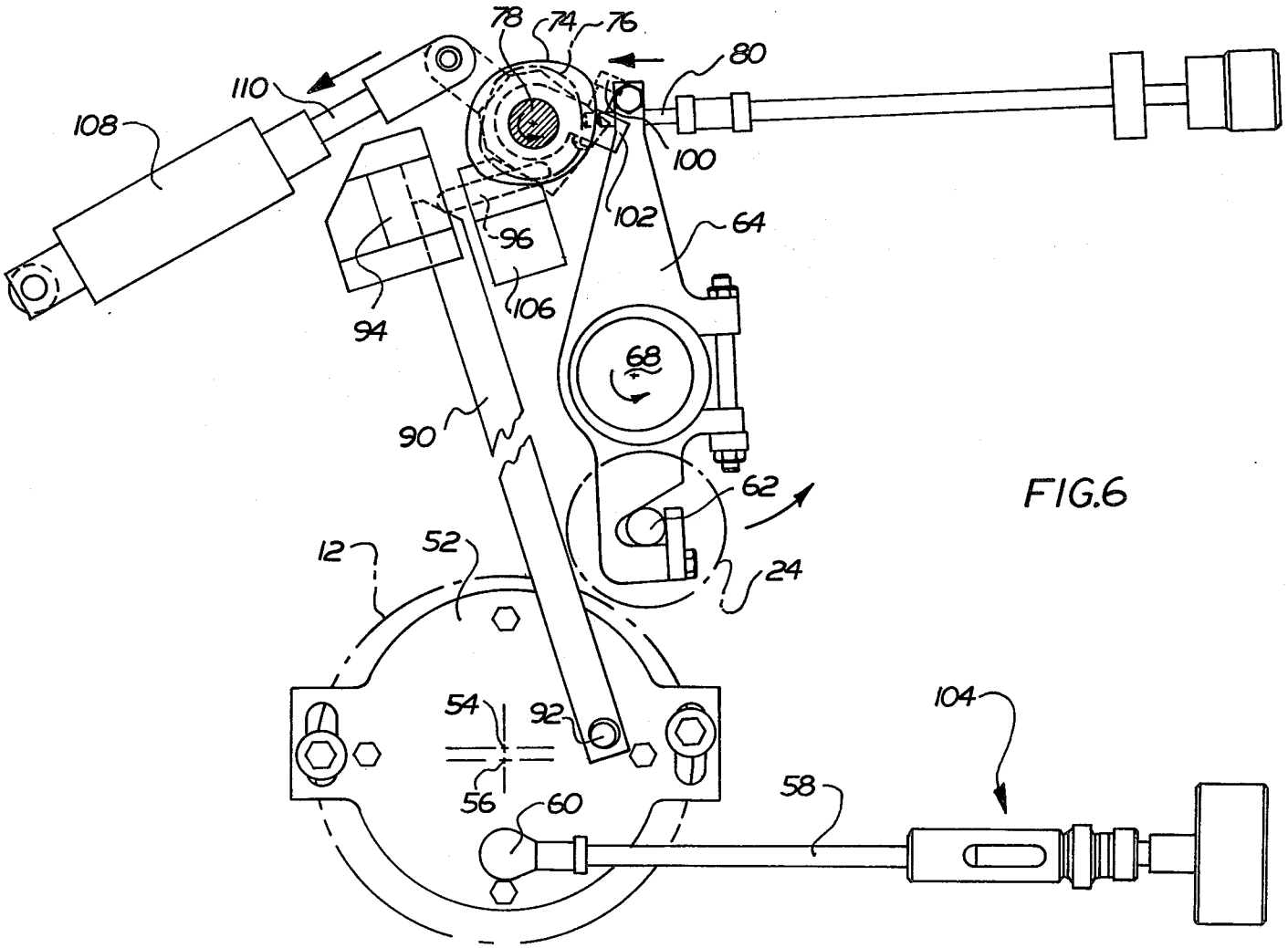

and,

FIGS. 4, 5 and 6 are more detailed side elevational views illustrating the operation of the mechanism of FIG. 3.

DETAILED DESCRIPTION

Figure 1:
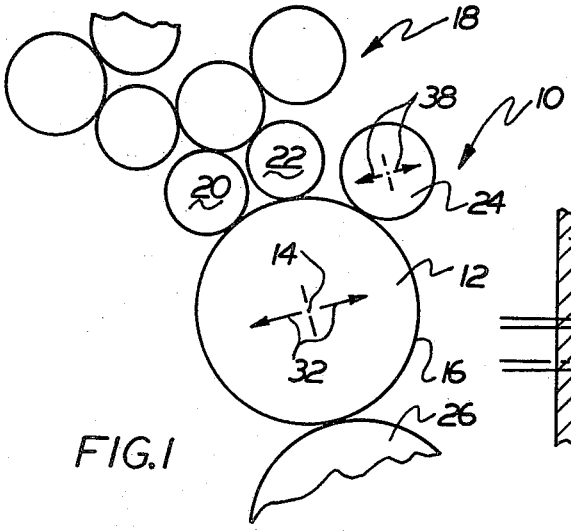
FIG. 1 is a schematic side elevational view of a portion of one type of rotary printing press in which the present invention may be used.

FIG. 1 illustrates a portion of a printing unit 10 embodying the present invention. The unit 10 may be one unit of a multicolor press comprised of plural units through which a common web passes. Each unit prints an image which must be in registry with the images printed by the other units. The printing unit 10 is an offset lithographic unit, but it will be appreciated that the present invention may also find use in other types of presses.

The unit 10 of FIG. 1 includes a plate cylinder 12 mounted for rotation on an axis 14 and having a circumferential surface 16 upon which is mounted a printing plate. An ink distribution system, generally indicated at 18, is provided for inking the plate mounted on the surface 16 of plate cylinder 12. The ink distribution system includes a number of ink form rollers 20, 22 and 24 which will normally be in rolling engagement with the plate cylinder 12. Also in rolling engagement with the plate cylinder 12 is a blanket cylinder 26 which receives the ink image from the plate cylinder for transferal to a web or sheet (not shown) passing thereunder.

Figure 2:
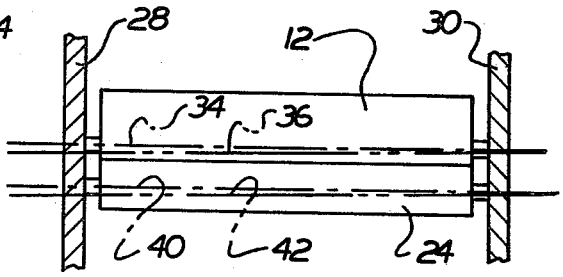
FIG. 2 is a schematic plan view illustrating relative orientations of a plate cylinder and a cooperating form of a printing press.

The plate cylinder 12 and blanket cylinder 26 are journaled for rotation between two end frames 28 and 30, see FIG. 2. The form rollers 20, 22 and 24 are mounted on pivotal hanger sockets so that the form rollers can be moved towards and away from the plate cylinder 12.

A number of registration adjustments are generally provided to control the location and orientation of the printed image on the web or sheet which is printed by the blanket cylinder 26. Such adjustments are important to provide precise registry of the images printed by the blanket cylinder 26 with images printed in the other printing units.

These registration adjustments include adjustments to move the plate cylinder 12 axially to translate the printed image in a direction transverse to the web or sheet movement. A second adjustment is a circumferential adjustment to permit movement of the printed image in a direction generally along the direction of web or sheet movement.

In some cases a third adjustment, referred to as a skew or cocking adjustment, is also provided. The purpose of this adjustment is to compensate for skew in the position of the plate on the plate cylinder 12 or for skew of the printed image upon the plate itself.

Skew adjustment is provided by mounting one end of the plate cylinder 12 in an eccentric 52 which is rotationally mounted on the side frame 28. Since the rotational axis of the eccentric 52 differs from the rotational axis of the plate cylinder, rotation of the eccentric produces a skew of the axis of the plate cylinder 12 relative to the axis of the blanket cylinder 26. The direction of this skew, indicated by the arrows 32 of FIG. 1, is generally perpendicular to the plane joining the axes of the plate cylinder 12 and blanket cylinder 26. This skew can be seen in FIG. 2, which is a plan view illustrating the orientations of the axis of the plate cylinder 12 in skewed and nonskewed positions. In FIG. 2 the dotted line 34 corresponds with the position of the axis of the plate cylinder 12 when in a nonskewed position, i.e., when the axis of the plate cylinder 12 is parallel to the axis of the blanket cylinder. The dotted line 36 represents a location of the axis of the plate cylinder 12 upon skewing thereof.

As the plate cylinder 12 is skewed relative to the blanket cylinder 26, its orientation with respect to the form rollers 20, 22 and 24 also changes. To avoid this, the form rollers such as form roller 24 is skewed by an amount which corresponds to the amount of skewing of the plate cylinder 12. Thus, the axes of the plate cylinder 12 and form roller 24 remains in parallelism even though both are skewed relative to the axis of the blanket cylinder. Again, the direction of such skew adjustments is indicated in FIG. 1 by the arrows 38, whereas the dotted lines 40 and 42 in FIG. 2 respectively represent the form roller axis locations when the form roller 24 is in skewed and nonskewed positions.

Referring now to FIG. 3, there is illustrated an automatic form roller skew adjustment and throw-on/throw-off mechanism in accordance with the present invention. Although in FIG. 3 the invention is shown as applied only to the form roller 24, it will be appreciated that the invention may similarly be applied to other form rollers (whether ink form or water form), such as form rollers 20 and 22 associated with the plate cylinder 12, or in fact to any press cylinder which is to be skewed in accordance with skewing of another cylinder.

In FIG. 3 the plate cylinder 12 is mounted on stub shafts. The stub shaft 50 at one of the plate cylinder 12 is journaled in eccentric 52 which is an eccentric bearing housing. The eccentric bearing housing 52 is, in turn, journaled for rotation in the side frame 28. The axis of rotation of the eccentric bearing housing 52 is offset from the axis 56 of the stub shaft 50 upon which the plate cylinder 12 is mounted. The stub shaft (not shown) on the other side of the plate cylinder 12, on the other hand, is rotationally mounted within self-aligning bearings carried in the side frame 30, itself, and hence does not move as the eccentric 52 is rotated. Consequently, rotation of the eccentric 52 produces bodily movement of one end of the plate cylinder 12 and pivotal movement of the other, resulting in a skewing or cocking of the plate cylinder 12 with respect to the blanket cylinder 26.

An adjusting arm 58 carries a socket 60 at one end thereof which receives a ball (not visible in the Figures) bolted near the periphery of the bearing housing 52. The adjusting arm 58 is connected at its other end through a turnbuckle arrangement to a bracket carried on the side frame 28. Adjustments in the length of the adjusting arm 58 will produce rotation of the eccentric 52, and hence skewing of the plate cylinder 12.

The form roller 24 is rotationally mounted on bearings carried by an axle 62. This axle is mounted at either end in hanger sockets 64 and 66. The hanger sockets 64 and 66 are pivotably supported midway along their length on a shaft 68, shown in phantom in FIG. 3, which is disposed generally parallel to the axes of the plate cylinder and form rollers. The shaft 68 passes through bushings carried in bores 70, 72 formed in hanger sockets 64, 66 respectively. Rotation of the hanger sockets 64 and 66 about the shaft 68 results in movement of the form roller 24 towards or away from the plate cylinder 12.

In accordance with the present invention, pivoting of the hanger sockets 64 and 66, and thus motion of the form roller 24, is controlled by a pair of cams 74 and 76 which are keyed on a cam shaft 78 extending tranversely between the side frames 28 and 30. The cam shaft is carried in bushings mounted in the side frames 28 and 30, and thus is rotatable with respect thereto. Each of these cams 74 and 76 is located at a transverse location along the cam shaft 78 which is adjacent an end of a corresponding one of the hanger sockets 64 and 66. Each of the hanger sockets 64 and 66 carries, at its end, a corresponding cam follower 80 and 82 which extends along a radius of the cam shaft 78 towards the corresponding cams 74 and 76. The cam followers 80 and 82 are resiliently biased against the cam surfaces by springs 84, 88 which are attached between the hanger sockets 64 and 66 and the side frames 28 and 30.

The orientation of the form roller 24 with respect to the plate cylinder 12 will depend upon the radial dimension of the cams 74 and 76 at the point of abutment of the cam followers 80 and 82. The cams 74 and 76 have profiled surfaces. It should be clear that rotation of the cam shaft 78 will produce pivoting of the hanger sockets 64 and 66 and thus movement of the form roller 24 relative to the plate cylinder 12. If upon rotation of cam shaft 74 the radial dimension of the cams 74 and 76 change similarly, then the hanger sockets 64 and 66 will pivot around the shaft 68 by a common amount, thus resulting in movement of the form roller 24 towards or away from the plate cylinder 12. If the change in radial dimension of the two cams 74 and 76 is not the same for the two cams, however, then one end of the form roller 24 will be moved to a greater extent that the other end, resulting in skewing of the form roller 24.

In accordance with the present invention, the cams 74, 76 are profiled so that the radial dimension of cam 74 diminishes more rapidly than the radial dimension of the cam 76 upon rotation of the cam shaft 78 in the direction indicated by the arrow 88. Consequently, rotation of the cam shaft 78 in that direction causes the hanger socket 64 to pivot to a greater extent than the hanger socket 66, resulting in a skew of the form roller 24. There is adequate looseness in the mounting of the axle 62 in the hanger sockets and the hanger sockets on the shaft 68 to permit this skewing movement without undue binding.

In the embodiment of FIG. 3, rotation of the cam shaft 78 is controlled by the eccentric 52 so that the form roller 24 is automatically skewed or cocked in accordance with skewing of the plate cylinder 12. Specifically, a rod 90 interconnects the shaft 78 and eccentric 52. The rod has an eye at one end thereof, which eye receives a pin 92 carried by the eccentric 52 near the perimeter thereof, and is secured thereon by a snap ring, not shown in this Figure, which snaps resiliently around a correspondingly shaped annular recess formed near the distal end of the pin 92. The pin 92 to which the adjusting arm is attached is located on the eccentric 52 such that the link rod 90 is disposed essentially perpendicular to the radius of the eccentric which intersects the point of attachment of the pin 92 to the eccentric 52. Because of this, rotation of the eccentric 52 by extension or retraction of the adjusting rod 58 will result in longitudinal movement of the link rod 90.

One longitudinal surface of the distal end of link rod 90 is supported by a cam plate 94 so that longitudinal movement of the link rod 90 results in sliding of the distal portion of link rod 90 along the cam plate 94. The opposing longitudinal surface of the link rod 90 near the distal end thereof is tapered to provide a camming surface 98. This camming surface 98 rotates the cam shaft 78 in response to rotation of the eccentric 52. A sliding piston 96 is disposed with one end in contact with the tapered surface 98 on the distal portion of link rod 90, and is disposed substantially perpendicular to the longitudinal dimension of the link rod 90. The opposite end of the sliding piston 96 contacts a plunger 100 carried by a follower arm 102 which may be rigidly affixed to the cam shaft 78 in any convenient fashion. The sliding piston is confined by a bore in a guide bracket, not shown in FIG. 3, within which it is, however, free to slide.

Upon skewing adjustment of the plate cylinder 12 by varying the length of the adjusting rod 58, the eccentric 52 will rotate upon its axis 54, thereby producing longitudinal movement of the link rod 90. As the link rod 90 moves longitudinally, the sliding piston 96 follows the tapered surface 98 thereof, in turn forcing the plunger 100 associated with the followr arm 102 to rotate the cam shaft 78.

This can be seen more clearly in FIGS. 4 and 5, which are end views of a mechanism conforming to that illustrated in FIG. 3, and which respectively illustrate the location of the various elements of the mechanism before and after skewing of the plate cylinder by rotation of the eccentric 52. For simplicity of description, parts of the mechanism of FIGS. 4, 5 and 6 which correspond to similar parts in FIG. 3 have been numbered similarly.

In FIG. 4 the plate cylinder 12 is in an unskewed position, wherein the link rod 90 is at such a longitudinal position that the sliding piston 96 is at an intermediate position along the tapered surface 98 of the link rod 90. The plunger 100 which follows the sliding piston 90 in this case abuts the end of sliding piston 96, hence the angular position of the cam shaft 78 is established by the dimension of the tapered surface 98 at the point against which the sliding piston 96 abuts.

It can be seen in FIG. 4 that the two cams 74 and 76 are of dissimilar sizes and shapes. The cam followers 80 and 82 associated with the hanger sockets 64 and 66 are threadedly received by their respective hanger sockets and may be screwed in or out to account for the general difference in size of the two cams. In FIG. 4 they have been adjusted so that the two hanger sockets 64 and 66 are aligned with one another, thus carrying the form roller 24 in an unskewed, thrown-on position adjacent the plate cylinder 12. The size and shape of the flat formed on the roller 24 by resilient contact with the cylinder 12 is also controlled by adjustments of the cam followers 80 and 82.

The cam 76 is profiled to have a constant radius over the portion of cam shaft rotation produced by the skew adjusting mechanism, whereby the hanger socket 66 remains essentially stationary upon skewing of the plate cylinder 12. The cam 74, on the other hand, has a camming surface which is profiled to be of changing radius as the cam shaft 78 is rotated due to skew of the plate cylinder. Thus, the hanger socket 68 is rotated either toward or away from the plate cylinder 12, depending upon the direction of rotation of the cam shaft 78. In FIG. 5, the cam shaft has been rotated in the counterclockwise direction; the radius of the cam surface at the point of cam follower contact diminishes upon this rotation, resulting in a slight pivoting of the hanger socket 64 away from the plate cylinder 12.

The profile of the cam 74 is selected so that the skewing movement of the form roller 24 matches the skewing of plate cylinder 12. As a result the axes of the plate cylinder 12 and form roller 24 remain in parallelism upon plate cylinder skewing.

In the embodiment illustrated, the cams 74, 76 are used to accomplish throw-on and throw-off of the form rollers. Thus, the camming surfaces of cams 74 and 76 are dimensioned such that rotation of the cam shaft 78 beyond the range of angular positions controlled by the link rod 90 will produce pivoting of both hanger sockets 66 and 64, causing the form roller 24 to be lifted off of the plate cylinder 12. A dual-action pneumatic linear actuator is used in the illustrated embodiment to accomplish this increased rotation of cam shaft 78 for throw-on and throw-off purposes. This linear actuator includes a cylinder 108, rigidly mounted relative to the side frames 28 and 30 and carrying a sliding piston fixed to a piston rod 110. The piston rod 110 has a clevis 112 formed at the free end thereof for attachment to a crank arm 114 which is keyed to the cam shaft 78.

When the form roller 24 is thrown on, the pneumatic actuator is operated to pneumatically bias the piston rod 110 in an extended position, thereby similarly biasing the plunger 100 against the sliding piston 96 which in turn abuts the tapered surface 98 of the link rod 90. In this event the rotational position of the cam shaft 78 is determined by the position of the eccentric 52 upon which the stub shaft 50 of the plate cylinder 12 is journaled.

To throw-off the form roller 24, the pneumatic actuator is operated so as to retract the piston rod 110. As can be seen in FIG. 6, this pulls the crank arm 114 around the cam shaft 78, thus rotating the cam shaft 78 by a corresponding amount. The rotation imparted to the cam shaft 78 by the retraction of the piston rod 110 is much greater in magnitude than the rotation imparted by the movement of the eccentric 52. The profiles of both cams 74 and 76 are selected such that the radial dimension at the points of cam follower contact diminish upon this extended rotation of the cam shaft 78. Consequently, both hanger sockets 64 and 66 pivot in a counterclockwise direction as viewed in FIG. 5 thus throwing off the form roller 24 from the plate cylinder 12.

Thus, the mechanism which has been described accomplishes the automatic skewing of the form roller 24 in accordance with skewing of the plate cylinder 12. Moreover, this same mechanism controls throw-on and throw-off of the form roller.

Although the invention has been described with respect to a preferred embodiment, it will of course be appreciated that many rearrangements and alterations of parts are also within the scope of the invention, as defined in the appended claims.

What is claimed is:

1. A rotary printing press comprising a pair of spaced side frames, a plate cylinder and a blanket cylinder journaled for rotation between said side frames, skew eccentric means mounting an end portion of the plate cylinder for shifting said end portion of the plate cylinder relative to the blanket cylinder upon rotation of said skew eccentric means to thereby skew the plate cylinder by an amount dependent upon the amount of rotation of said skew eccentric means, a form roll located adjacent said plate cylinder and mounted for rotation on an axle, supporting means for supporting said form roll including first and second hangers, each attached to a corresponding end of said axle and each pivotally mounted for swinging movement of the form roll toward and away from the plate cylinder, a shaft disposed generally parallel to the axis of said form roll, first and second cams connected with said shaft for rotation together with said shaft, each of said cams associated with a respective one of said first and second hangers, first and second cam followers for following an associated one of said cams and each of said cam followers being operatively connected to the corresponding one of said pivoting hangers so as to pivot said hanger by an extent which is dependent upon the rotary position of said cam, and a linkage connected between said skew eccentric means and said shaft for rotating said shaft by an amount dependent upon the amount of rotation of said eccentric, said first and second cams having different profiles and including surface means for moving first and second hangers supporting opposite ends of said form roll relative to one another thereby to skew the form roll by an amount corresponding to the skewing of the plate cylinder, whereby said form roll is automatically skewed in response to skewing of said plate cylinder, and throw off means for rotating said shaft beyond the range of movement controlled by said linkage, said first and second cams including surface means for pivoting each of said cam follower means and its associated hanger upon such rotation of said shaft, to thereby throw off the associated end of said form roll from said plate cylinder.

2. A rotary printing press including a frame, a plate cylinder rotatably mounted in said frame, skew means for varying the angle of the axis of rotation of said plate cylinder with respect to said frame, a form roll disposed in rolling engagement with said plate cylinder, first and second hangers pivotably mounted in said frame for rotation about a pivot axis which is fixed with respect to said frame, said first and second hangers supporting axially opposite ends of said form roll, a first cam rotatable to control pivoting movement of said first hanger, a second cam rotatable to control pivoting movement of said second hanger, said first hanger including a cam follower biased into engagement with said first cam, said second hanger including a second cam follower biased into contact with said second cam, skew actuation means for rotating both said first cam and said second cam through a first arcuate extend over which said first and second cam followers are disposed in engagement with respective first surface portions of said first and second cams in response to skew movement of said plate cylinder to effect a corresponding skew movement of said form roll, throw off actuation means for rotating both said first cam and said second cam through a second arcuate extent in which said first and second cam followers are disposed in engagement with second surface portions of said first and second cams, respectively, to effect throw off of said form roll from said plate cylinder, said first surface portion of said first cam being contoured so that rotation of said first cam through said first arcuate extent produces no substantial movement of said first cam follower whereby one of said ends of said form roll maintains a constant position in said frame, said second surface portion of said first cam is contoured so that rotation of said first cam over said second arcuate extent produces a relatively large movement of said first cam follower to throw said one of said opposite ends of said form roll off said plate cylinder, said first surface portion of said second cam being contoured so that rotation of said second cam through said first arcuate extent produces a relatively small movement of said second cam follower whereby the other of said ends of said form roll moves to effect skew movement of said form roll in said frame, and said second surface portion of said second cam being contoured so that rotation of said second cam through said second arcuate extent produces relatively large movement of said second cam follower to throw said other of said ends of said form roll off said plate cylinder, said first and second cams being disposed in a phase relationship in which said first cam follower is in contact with said first surface portion of said first cam when said second cam follower is in contact with said first surface portion of said second cam.

3. A rotary printing press including a frame, a plate cylinder rotatably mounted in said frame, skew means for varying the angle of the axis of rotation of said plate cylinder with respect to said frame, a form roll disposed in rolling engagement with said plate cylinder, first and second hangers pivotably mounted in said frame for rotation about a pivot axis which is fixed with respect to said frame, said first and second hangers supporting axially opposite ends of said form roll, a first cam rotatable to control pivoting movement of said first hanger, a second cam rotatable to control pivoting movement of said second hanger, said first hanger including a cam follower biased into engagement with said first cam, said second hanger including a second cam follower biased into contact with said second cam, skew actuation means for rotating both said first cam and said second cam through a first arcuate extent over which said first and second cam followers are disposed in engagement with respective first surface portions of said first and second cams in response to skew movement of said plate cylinder to effect a corresponding skew movement of said form roll, throw off actuation means for rotating both said first cam and said second cam through a second arcuate extent in which said first and second cam followers are disposed in engagement with second surface portions of said first and second cams, respectively, to effect throw off of said form roll from said plate cylinder, said skew means including an eccentric bushing rotatably received in said frame and supporting one end portion of said plate cylinder, a shaft fixedly connected with said first and second cams and linkage means for connecting said eccentric bushing and said shaft for transmitting rotary motion of said eccentric bushing to said shaft.

4. A rotary press as set forth in claim 3 wherein said linkage means includes stop surface means for limiting rotary movement of said shaft in one direction, said stop surface means being movable in response to rotation of said eccentric to thereby vary the limit of the extent of rotary movement of said shaft in said one direction.

5. A rotary press as set forth in claim 4 wherein said throw off actuation means includes an arm extending radially from said shaft and a piston and cylinder movable relative to each other and pivotably connected between said arm and said frame, said shaft rotating in a first direction upon relative movement of said piston and cylinder in a first direction to effect throw off of said form roll, said shaft rotating in the opposite direction to a position determined by the position of said stop surface means upon relative movement of said piston and cylinder in the opposite direction.

* * * * *